US008079128B2

(12) United States Patent
Sander et al.

(10) Patent No.: US 8,079,128 B2
(45) Date of Patent: Dec. 20, 2011

(54) METHOD FOR ASSEMBLING RELEASABLE AND INTERCHANGEABLE CONNECTIONS FOR GOLF CLUB HEADS AND SHAFTS

(75) Inventors: Raymond J. Sander, Benbrook, TX (US); James S. Thomas, Fort Worth, TX (US); Matthew P. Rubal, Columbus, OH (US); Gregory A. Trees, Columbus, OH (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/939,476

(22) Filed: Nov. 4, 2010

(65) Prior Publication Data

US 2011/0047778 A1 Mar. 3, 2011

Related U.S. Application Data

(63) Continuation of application No. 12/404,686, filed on Mar. 16, 2009, now Pat. No. 7,850,540.

(51) Int. Cl.
*B21D 39/00* (2006.01)
*A63B 53/02* (2006.01)

(52) U.S. Cl. ..... 29/525.01; 29/525.02; 29/525.03; 473/307; 473/309

(58) Field of Classification Search ..... 29/525.01, 29/525.02, 525.03; 473/307, 309
See application file for complete search history.

(56) References Cited

U.S. PATENT DOCUMENTS

| | | | |
|---|---|---|---|
| 1,266,529 | A | 5/1918 | Mattem |
| 1,792,852 | A | 12/1926 | Mattem |
| 1,623,523 | A | 4/1927 | Bourke |
| 1,634,082 | A | 6/1927 | Rigby |
| 1,850,843 | A | 3/1932 | Lagerblade |
| 2,067,556 | A | 1/1937 | Wettlaufer |
| 2,219,670 | A | 10/1940 | Wettlaufer |
| 2,451,262 | A | 10/1948 | Watkins |
| 2,464,850 | A | 3/1949 | Crawshaw |
| 3,206,206 | A | 9/1965 | Santosuosso |
| 3,516,697 | A | 6/1970 | Hahn |
| 3,524,646 | A | 8/1970 | Wheeler |
| 3,656,366 | A | 4/1972 | Somero |
| 3,848,737 | A | 11/1974 | Kenon |
| 3,891,212 | A | 6/1975 | Hill |
| 4,253,666 | A | 3/1981 | Murphy |

(Continued)

FOREIGN PATENT DOCUMENTS

| | | |
|---|---|---|
| GB | 392493 | 5/1933 |

(Continued)

OTHER PUBLICATIONS

International Search Report corresponding to International PCT Application No. PCT/US2010/025880, dated Dec. 6, 2010.

(Continued)

*Primary Examiner* — Jermie Cozart
(74) *Attorney, Agent, or Firm* — Banner & Witcoff, Ltd.

(57) ABSTRACT

Golf club heads are releasably engaged with shafts so that the club heads and shafts can be readily interchanged and/or so that the shaft position with respect to the club head can be readily changed. Assemblies for connecting the club head and shaft may include: a shaft adapter, a collet, a ferrule, and a club head having an interior chamber. The club head and shaft may be changed by releasing the securing system and exchanging the original parts with different parts. Furthermore, the shaft may be bent or otherwise extend at an angle from the shaft adapter so as to allow adjustment of the shaft position with respect to the club head.

18 Claims, 6 Drawing Sheets

U.S. PATENT DOCUMENTS

| | | | |
|---|---|---|---|
| 4,340,227 | A | 7/1982 | Dopkowski |
| 4,664,382 | A | 5/1987 | Palmer et al. |
| 4,948,132 | A | 8/1990 | Wharton |
| 4,984,794 | A | 1/1991 | Pernelle et al. |
| 5,165,688 | A | 11/1992 | Schmidt |
| 5,232,224 | A | 8/1993 | Zeider |
| 5,275,399 | A | 1/1994 | Schmidt |
| 5,275,408 | A | 1/1994 | Desbiolles et al. |
| 5,429,355 | A | 7/1995 | Schmidt |
| 5,433,442 | A | 7/1995 | Walker |
| 5,577,726 | A | 11/1996 | Fenton |
| 5,588,921 | A | 12/1996 | Parsick |
| 5,626,528 | A | 5/1997 | Toulon |
| 5,839,973 | A | 11/1998 | Jackson |
| 5,851,155 | A | 12/1998 | Wood et al. |
| 5,855,526 | A | 1/1999 | Honma |
| 5,906,549 | A | 5/1999 | Kubica |
| 6,095,929 | A | 8/2000 | Clark |
| 6,149,533 | A | 11/2000 | Finn |
| 6,203,443 | B1 | 3/2001 | Britton |
| 6,251,028 | B1 | 6/2001 | Jackson |
| 6,270,425 | B1 | 8/2001 | Dyer |
| 6,273,828 | B1 | 8/2001 | Wood et al. |
| 6,287,215 | B1 | 9/2001 | Fisher |
| 6,319,146 | B1 | 11/2001 | Mills |
| 6,332,945 | B1 | 12/2001 | Lenhof |
| 6,447,404 | B1 | 9/2002 | Wilbur |
| 6,508,288 | B2 | 1/2003 | Lenhof |
| 6,547,673 | B2 | 4/2003 | Roark |
| 6,652,388 | B1 | 11/2003 | Lenhof |
| 6,669,573 | B2 | 12/2003 | Wood et al. |
| 6,797,106 | B2 | 9/2004 | Lenhof |
| 7,017,252 | B2 | 3/2006 | Lenhof |
| 7,083,529 | B2 | 8/2006 | Cackett |
| 7,115,046 | B1 | 10/2006 | Evans |
| 7,300,359 | B2 | 11/2007 | Hocknell |
| 7,316,622 | B1 | 1/2008 | Lucas |
| 7,326,126 | B2 | 2/2008 | Holt |
| 7,335,113 | B2 | 2/2008 | Hocknell |
| 7,344,449 | B2 | 3/2008 | Hocknell |
| 2002/0037773 | A1 | 3/2002 | Wood et al. |
| 2006/0293116 | A1 | 12/2006 | Hocknell et al. |
| 2007/0004528 | A1 | 1/2007 | Hocknell et al. |
| 2008/0051211 | A1 | 2/2008 | Hocknell |
| 2008/0058114 | A1 | 3/2008 | Hocknell |
| 2008/0070717 | A1 | 3/2008 | Hocknell |
| 2008/0280693 | A1 | 11/2008 | Chai |
| 2009/0011850 | A1 | 1/2009 | Stites et al. |

FOREIGN PATENT DOCUMENTS

| | | |
|---|---|---|
| GB | 443439 | 2/1936 |
| GB | 2331464 | 5/1999 |
| JP | 2000024143 | 1/2000 |
| JP | 2000093569 | 4/2000 |
| JP | 2006042950 | 2/2006 |
| JP | 2006042951 | 2/2006 |
| WO | 9000424 | 1/1990 |
| WO | 2007022671 | 3/2007 |

OTHER PUBLICATIONS

European Search Report from European Patent Application No. 03748963.0, dated Apr. 7, 2008.

International Search Report in corresponding PCT Application, International Application No. PCT/US2008/073703, mailed Jan. 21, 2009.

METHOD FOR ASSEMBLING RELEASABLE AND INTERCHANGEABLE CONNECTIONS FOR GOLF CLUB HEADS AND SHAFTS

RELATED APPLICATION

This application claims priority to Non-Provisional Application, U.S. Ser. No. 12/404,686, filed Mar. 16, 2009, which is incorporated herein by reference in its entirety now U.S. Pat. No. 7,850,540 B2.

FIELD OF THE INVENTION

This invention relates generally to golf clubs and golf club heads. More particularly, aspects of this invention relate to golf clubs having releasable connections between the golf club head and the shaft and head/shaft position adjusting features to allow easy interchange of shafts and heads and to allow easy modification of the head/shaft positioning properties. Additionally, certain features of this invention are similar in structure and function to features of the invention as described, for example, in U.S. patent application Ser. No. 11/774,513 filed Jul. 6, 2007 in the names of Gary G. Tavares, et al., which application is entirely incorporated herein by reference now U.S. Pat. No. 7,722,474 B2.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands and, in recent years, the industry has witnessed dramatic changes and improvements in golf equipment. For example, a wide range of different golf ball models are available now, with balls designed to complement specific swing speeds and/or other player characteristics or preferences (e.g., some balls are designed to fly farther and/or straighter; some are designed to provide higher or flatter trajectories; some are designed to provide more spin, control, and/or feel (particularly around the greens); some are designed for faster or slower swing speeds; etc.). A host of swing and/or teaching aids that promise to help lower one's golf scores also are available on the market.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts (e.g., from different manufacturers; having different flex ratings, flex points, kick points, or other flexion characteristics, etc.; made from different materials; etc.). Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the club heads and shafts can be readily interchanged and/or so that the angle and/or position of the shaft with respect to the club head body (and its ball striking face) can be readily changed. Golf club head/shaft connection assemblies in accordance with examples of this invention may include a golf club head that has an interior chamber for receiving an insertable, releasable collet. In some embodiments, the collet may have an inner periphery and an outer periphery. In such embodiments, the inner periphery may have an offset axis relative to the axis of the outer periphery of the collet. In further embodiments, the club head may have a hosel area that may receive the collet in a plurality of different configurations, wherein one configuration may provide different club characteristics than another configuration. In still another example, a shaft or shaft adapter may have one or more direction change regions for offsetting the shaft axis in relation to the hosel axis of the head of the club.

Further aspects of the invention relate to marketing, selling, manufacturing, or utilizing one or more components of the golf club as a kit. One such embodiment may include a kit comprising a golf club head having an interior chamber configured to receive an insertable, releasable collet that may be configured to receive an insertable shaft adapter. The same kit may be associated with instructions for constructing a golf club by choosing between one or more heads, shafts, collets, shaft adapters, grips, etc. In certain embodiments, the instructions describe a method for: releasably inserting a collet having an upper end and a lower end into the interior chamber, wherein the lower end comprises a rotation inhibiting structure configured to mate at least a portion of a rotation inhibiting structure of the interior chamber of the golf club head. In one embodiment, there is a plurality of possible configurations in which the collet may be received within the golf club head, wherein at least one configuration provides different club characteristics than another configuration. The instructions may further describe a method of releasably inserting a shaft adapter into the collet and securing a ferrule to the collet, constricting the diameter of the collet.

Furthermore, the interior of the collet, the shaft, and/or the shaft adapter may be angled with respect to the axial direction of the club head hosel or club head engaging member so as to allow adjustment of the angle or position of the shaft with respect to the club head (e.g., with respect to its ball striking face). Instructions for making the adjustments and/or information detailing the characteristics of the club in relation to the adjustments may also be provided as part of one or more kits in accordance with embodiments of the invention.

BRIEF DESCRIPTION OF THE DRAWINGS

A more complete understanding of the present invention and certain advantages thereof may be acquired by referring to the following detailed description in consideration with the accompanying drawings, in which:

FIG. 3A shows a perspective view of a shaft adapter and FIG. 3B shows a cross-sectional view of the shaft adapter of FIG. 3A taken along line 3B;

FIG. 4A shows a perspective view of a collet, FIGS. 4B and 4C show top views of two illustrative collets and FIGS. 4D and 4E show cross-sectional views of the illustrative collets depicted in FIGS. 4B and 4C, respectively;

The reader is advised that the attached drawings are not necessarily drawn to scale.

DETAILED DESCRIPTION

In the following description of various example structures in accordance with the invention, reference is made to the accompanying drawings, which form a part hereof, and in which are shown, by way of illustration, various example connection assemblies, golf club heads, and golf club structures in accordance with aspects of the invention. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to systems and methods for connecting golf club heads to shafts in a releasable manner so that the club heads and shafts can be readily interchanged and/or repositioned with respect to one another. Specific examples of the invention are described in more detail below. The reader should understand that these specific examples are set forth merely to illustrate examples of the invention, and they should not be construed as limiting the invention.

A. Examples of Specific Embodiments

1. Illustrative Club Structure

Figure 1:
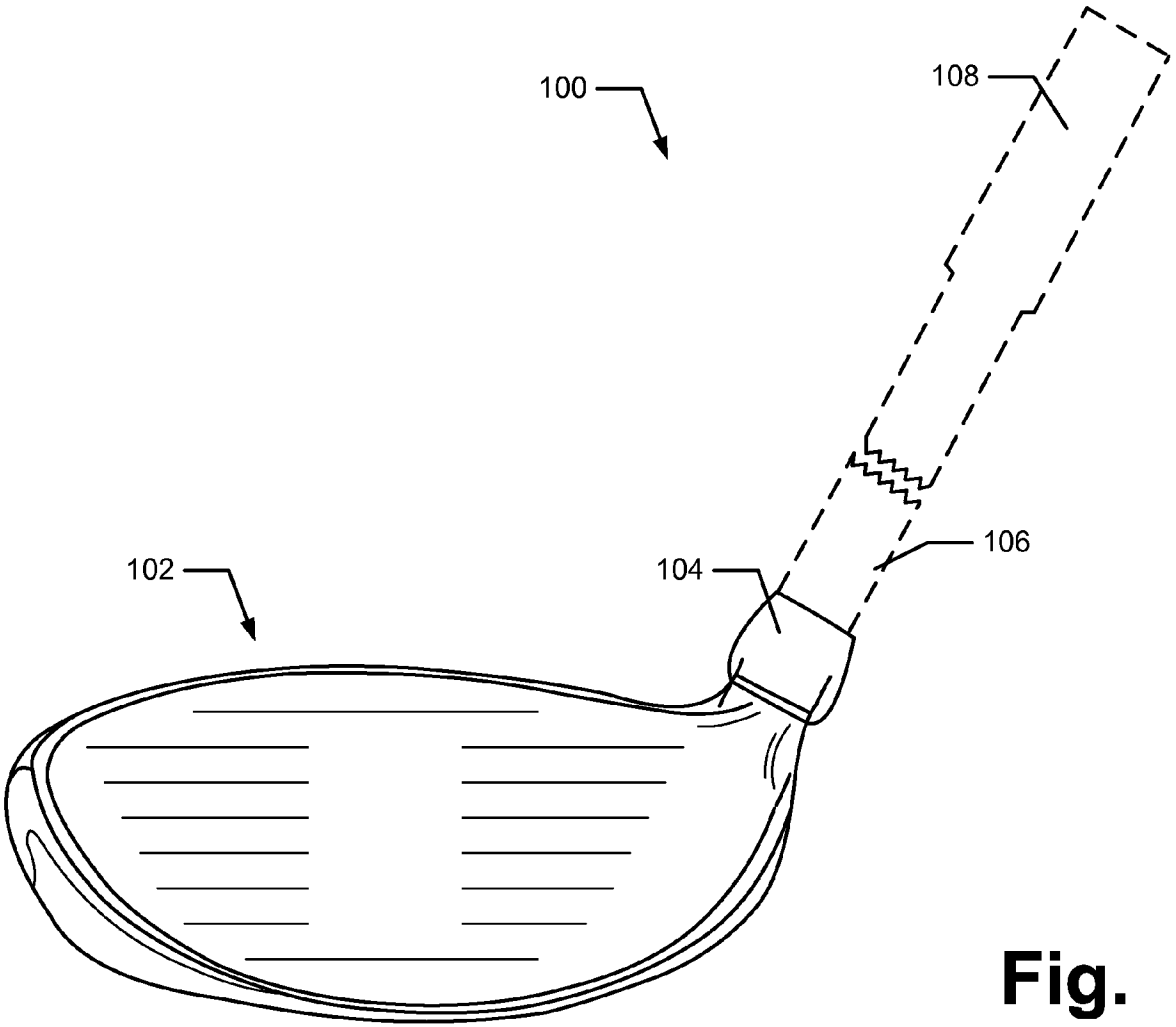
FIG. 1 generally illustrates a frontal view of an illustrative golf club according to embodiments of the invention.

FIG. 1 generally illustrates an illustrative golf club 100 in accordance with at least some embodiments of the invention. Illustrative club 100 includes a club head 102, a releasable club head/shaft connection assembly 104 that connects the club head 102 to a shaft 106 (which will be described in more detail below), and a grip member 108 engaged with the shaft 106. While a driver wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from suitable materials, in suitable constructions, in suitable manners, as are known and used in the art, optionally modified (if necessary, e.g., in size, shape, etc.) to accommodate the releasable club head/shaft connection parts.

The various parts of the club head/shaft connection assembly 104 may be made from any desired or suitable materials without departing from this invention. For example, one or more of the various parts may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts may be made from rigid polymeric materials, such as polymeric materials conventionally known and used in the golf club industry. The various parts may be made from the same or different materials without departing from this invention. In one specific example, each of the various parts will be made from a 7075 aluminum alloy material having a hard anodized finish. The parts may be made in suitable manners as are known and used in the metal working and/or polymer production arts.

Any desired materials also may be used for the shaft member 106, including suitable materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 108 may be engaged with the shaft 106 in any desired manner, including in any suitable manners that are known and used in the art (e.g., via cements or adhesives, via mechanical connections, etc.). Any desired materials may be used for the grip member 108, including suitable materials that are known and used in the art, such as rubber, polymeric materials, cork, rubber or polymeric materials with cord or other fabric elements embedded therein, cloth or fabric, tape, etc. Optionally, if desired, the grip member 108 (or any suitable handle member) may be releasably connected to the shaft 106 using a releasable connection like releasable connection assembly 104 (examples of which will be described in more detail below).

The releasable connection assembly 104 between golf club heads and shafts in accordance with some examples of this invention now will be described in more detail in conjunction with FIGS. 2 through 7.

2. Illustrative Club Head

Figure 2A:
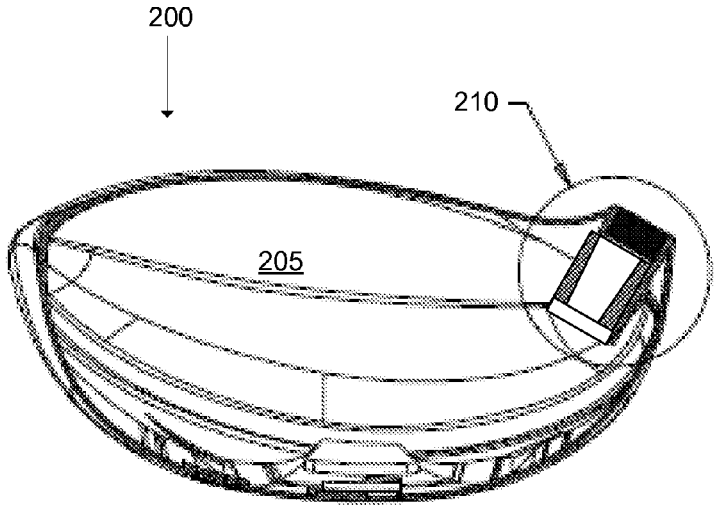
FIG. 2A provides a perspective view of an illustrative golf club head showing a detailed sectional view of its hosel area.

FIG. 2A provides a perspective view of an illustrative golf club head showing a detailed sectional view of its hosel area. FIG. 2B provides an enlarged sectional view of the hosel area shown in FIG. 2A. Looking first to FIG. 2A, golf club head 200 has a "face" or striking surface 205 that is configured to strike a golf ball during normal use. As discussed above, the shape, size, and characteristics of the striking surface may vary depending on various factors, including the type of club and/or specific preferences of the intended user. Golf club head 200 further includes a hosel area 210 disposed therein. As will be appreciated by those skilled in the art, the size and/or location of hosel area 210 may also depend on the type of club and/or a particular configuration to accommodate an intended user, such as whether the user is right-handed or left-handed.

a. Interior Chamber

Illustrative hosel area 210 includes an interior chamber 215 along axis 217 configured to receive an insertable, releasable collet which, in turn, is configured to receive an insertable shaft or shaft adapter. Additionally, in some embodiments, interior chamber 215 may be configured to receive a ferrule, which will be described below. Interior chamber 215 along axis 217 may be machined into the golf club head 200 during manufacturing of the head. In one embodiment, interior chamber 215 along axis 217 is created by drilling or otherwise excavating a portion of golf club head 200. In this regard, at least a portion of the outer perimeter of interior chamber 215 along axis 217 includes the same materials as the golf club head 200. Yet in other embodiments, one or more different materials may be secured in any desired manner, e.g., via cements or adhesives; via welding, brazing, soldering, or other fusing techniques; via mechanical connectors; via a friction fit; etc. In one embodiment, the one or more materials may be less dense than the surrounding portion of the golf club head 200, so as to provide absorbing properties and/or snug fit.

Interior chamber 215 along axis 217 includes a receiving mechanism 220 proximate to the exterior portion of the golf club head 200. Placement of the receiving mechanism 220 within the interior chamber 215 along axis 217 reduces the likelihood of damaging the receiving mechanism 220 when using and storing the club head 200, even in the event of external damage to the club head. The receiving mechanism 220 is configured to releasably receive and secure a collet or ferrule (400 and 500, respectively, discussed below).

In some embodiments, receiving mechanism 220 may be cast as a part of the club head itself. In other embodiments, receiving mechanism 220 may be a separate component that may be inserted into interior chamber 215 of the club head, through any of the suitable manners that are known and used in the art (e.g., via cements or adhesives, via mechanical connections, etc.). As shown in FIG. 2B, this example receiving mechanism 220 includes the outer perimeter of interior chamber 215, which releasably engages collet 400. In other embodiments, receiving mechanism 220 may include a separate component. In some embodiments, regardless of whether receiving mechanism 220 includes the outer perimeter of interior chamber 215 or a separate component, receiving mechanism 220 may include threaded securing structures that are configured to threadingly engage threaded structures of a complementing collet or ferrule. The use of threaded structures permits tight precise fittings and allows for the quick separation of the golf club head 200 from a collet or ferrule. While receiving mechanism 220 may include the outer perimeter of interior chamber 215 and/or threaded securing structures in certain embodiments, those skilled in the art with the benefit of this disclosure will readily appreciate that any receiving mechanism that releasably receives and secures a collet or ferrule is within the scope of the invention. For example, the receiving mechanism 220 may include other structures that hold a collet or ferrule in place. If desired, slots, openings, or grooves that provide access to structures extending from or into the interior chamber 215 and/or the shaft retainer may be used to hold these components in place with respect to one another. In some embodiments, the collet or ferrule may be releasably engaged via a press fit or friction fit.

b. Rotation Inhibiting Structure

The interior chamber 215 along axis 217 in this example hosel structure 210 further includes rotation inhibiting structure 225. While rotation inhibiting structure 225 is shown in FIG. 2B as being in direct proximity to receiving mechanism 220, this is merely a visual representation of one embodiment and other embodiments may locate the rotation inhibiting structure 225 relatively distant from the receiving mechanism 220.

Figure 2C:
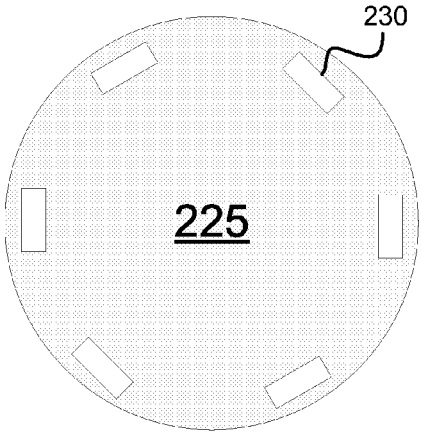
FIG. 2C provides a top view of illustrative rotation-inhibiting structures that may be used in the hosel area of FIG. 2B.
Figure 2B:
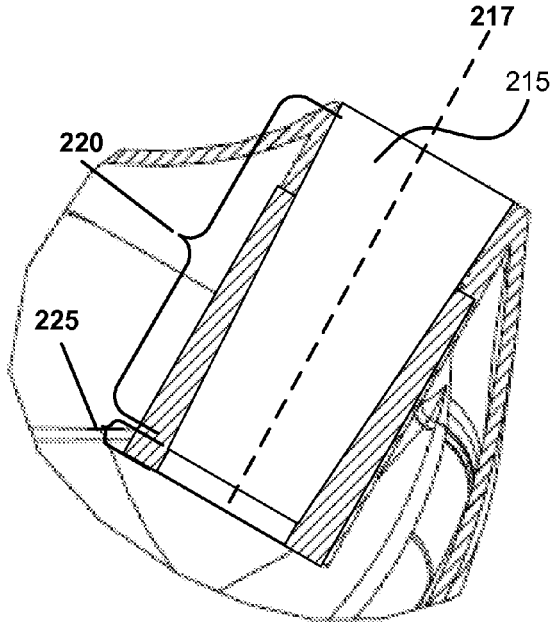
FIG. 2B provides an enlarged sectional view of the hosel area shown in FIG. 2A.

Illustrative rotation inhibiting structure 225 shown in FIG. 2C includes six holes 230. As seen in this example, each of the six holes 230 is substantially the same size as the other holes which are spaced around the perimeter of structure 225. In some illustrative structures according to the invention, the holes 230 of the rotation inhibiting structure of interior chamber 215 may be irregularly shaped or spaced. This may be useful, for example, where it is desirable that a collet or shaft adapter not be inserted in a manner that would not provide good club characteristics. Rotation inhibiting structure 225 may have any number of holes 230. The number of holes 230, in addition to the shape, orientation, and spacing of holes 230 may be chosen to limit configuration options or may be chosen to allow many different configuration options. While FIG. 2C depicts six holes 230—limiting the number of different configurations to six—other embodiments may have any number of possible configurations. In one embodiment, there are numerous possible configurations that the collet or shaft adapter may be received within the golf club head, wherein at least one configuration provides different club characteristics than another configuration.

3. Shaft Adapter

Figure 3B:
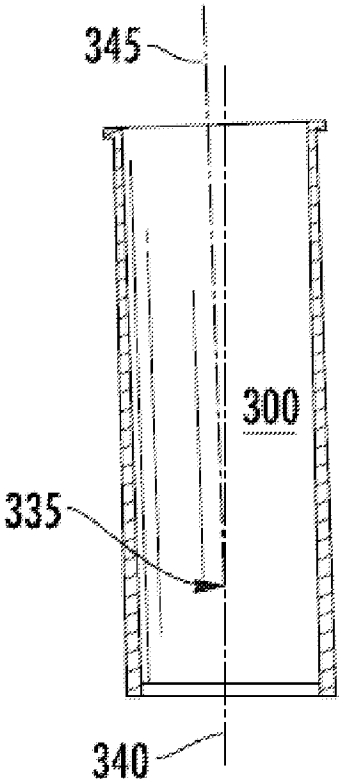
FIGS. 3A and 3B show an illustrative shaft adapter according to one embodiment of the invention; specifically.
Figure 3A:
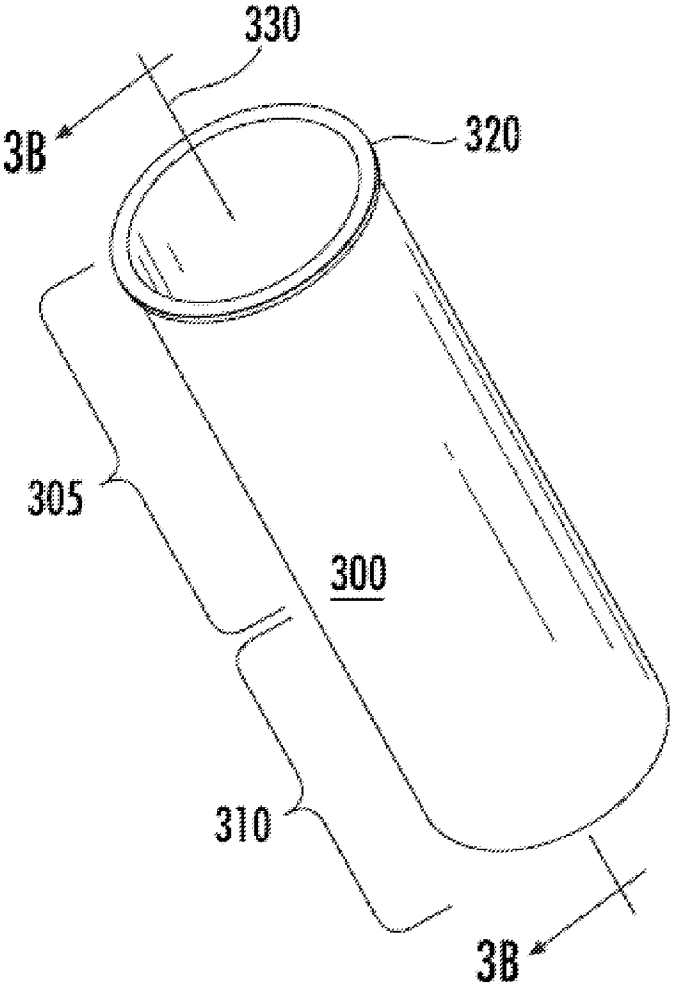

FIG. 3A shows a perspective view of shaft adapter 300. Shaft adapter 300 has an upper end 305 and a lower end 310. The upper end 305 is configured to securely attach to a club shaft (not shown), e.g., by cements or adhesives, by mechanical connectors (optionally releasable connectors), by friction fit, etc. As seen in FIG. 3A, the illustrative shaft adapter 300 may be hollow and may be sized to receive a free end portion of a golf shaft. Yet in other embodiments, the illustrative shaft adapter 300 may be sized to be received within a hollow portion at the free end of a golf shaft. Those skilled in the art will readily appreciate that the shaft adapter 300 is not required to be hollow and may securely attach to a club shaft by any suitable methods and mechanisms, including for example, e.g., via cements or adhesives; via welding, brazing, soldering, or other fusing techniques; via mechanical connectors; via a friction fit; etc. Further, the connection of the shaft adapter 300 to a shaft, such as shaft 106, may be releasable, so as to allow shafts to be easily and quickly switched.

Shaft adapter 300 may be made from one or more suitable materials and may include materials that are different than the materials including the remaining sections of the golf club. For example, in one embodiment, shaft adapter 300 may include rubber or another compressible material that may increase the surface tension and/or reduce movement between shaft adapter 300, the shaft member 106, and/or collet (400, described below). In yet other embodiments, rubber and/or other materials may be used to increase shock absorbency and/or to reduce noise during a ball strike. In some embodiments, the shaft adapter may result in a different overall thickness in the portion of the combined shaft and shaft adapter 300 that is received by the collet than in other embodiments. In certain embodiments, shaft adapter 300 may be integral to or otherwise permanently affixed to the shaft. This may be advantageous, for example, to prevent a user from using a less-than desirable shaft with a specific club head.

In some embodiments, upper end 305 of shaft adapter 300 may contain a lip 320 (or other suitable means or mechanism) that may prevent other components that are coaxially, slidably engaged along the shaft from moving below shaft adapter 300.

In other embodiments, shaft adapter 300 may include a direction change region. Additional aspects of this invention relate to utilizing releasable golf club head/shaft connection assemblies to enable club fitters (or others) to adjust various positions and/or angles of the club head (and its ball striking face) with respect to the free (grip) end of the shaft (e.g., face angle, lie angle, loft angle, etc.). For example, FIG. 3B shows a cross sectional view of one embodiment of shaft adapter 300 along axis 330 of FIG. 3A. As shown in FIG. 3B, shaft adapter 300 may include an axial direction change region 335 that extends coaxially toward a first axial direction 340 away from region 335. The direction change region 335 also extends coaxially toward a second axial direction 345. The axial direction change region 335 may be located at any desired position along shaft adapter 300 without departing from this invention, and in this example structure, the axial direction changes at the bottom of the hole in which the shaft is received. In certain embodiments, the axial direction change region 335 may be located in the lower end 310 of shaft adapter 300 nearer to the club head 102 than to the grip end. In some more specific examples, the axial direction change region 335 may be located in the lower quarter of shaft adapter 300 nearest to the club head 102, and even in the lower 10% or 5% of shaft adapter 300 nearest to the club head 102.

In yet further embodiments, such as the illustrative embodiments shown in FIG. 3B, the direction change region 335 may be positioned within the lower end 310 of shaft adapter 300. However, at least a portion of the outer perimeter of shaft adapter 300 in that region 335 remains substantially aligned with first axial direction 340, while the inner perimeter of shaft adapter 300 is substantially aligned with second axial direction 345. In other words, the axial direction of the interior chamber of shaft adapter 300 will be offset and different from the axial direction of the lower end 310 of shaft adapter 300 and/or the hosel axis direction of the club head. As another example, if desired, the exterior of shaft adapter 300 may extend in one axial direction 340 while the interior chamber that receives the shaft extends in a second axial direction 345 (e.g., a slanted hole for receiving the shaft). Those skilled in the art will readily appreciate upon review of this disclosure various combinations of structural elements that may be used to implement direction change region 335 without departing from the scope of the invention. Any desired axial direction change angles may be used without departing from this invention, e.g., at least 0.25 degrees, at least 0.5 degrees, at least 1 degree, at least 2 degrees, at least 2.5 degrees, at least 4 degrees, or even at least 8 degrees.

Depending on how shaft adapter 300 is placed within club head 102 (an example of which will be explained in more detail below when describing FIGS. 7A and 7B), and thus how direction change region 335 is oriented in relation to the "face" of the club head 102, the playing characteristics of the club may be modified. This feature, along with the releasable connection assembly 104, allows club fitters (or others) to freely and easily adjust various angles and/or positions of the shaft 106 with respect to the club head 102 (e.g., variable lie, loft, and face angle combinations) while still using the same shaft 106 and/or head 102, which can help users more easily determine the optimum club head/shaft combination and arrangement to suit their needs.

If desired, shaft adapter 300 and/or some portion of the club head may be marked with indicia to indicate the rotational position of the shaft adapter 300 with respect to the club head 102, e.g., to allow users to better record the club head/shaft orientation and/or to allow a reliable return to a previous position after rotation of the shaft has taken place.

4. Collet

Figure 4C:
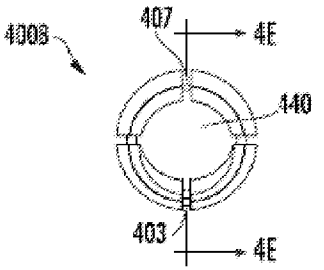
FIGS. 4A-4E show illustrative collets according to embodiments of the invention; specifically.
Figure 4E:
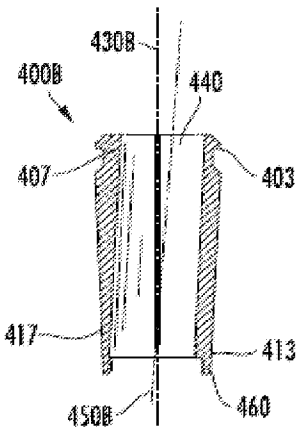
Figure 4B:
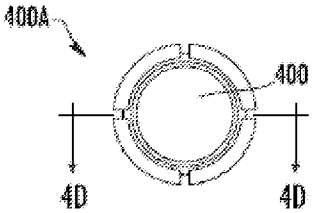
Figure 4D:
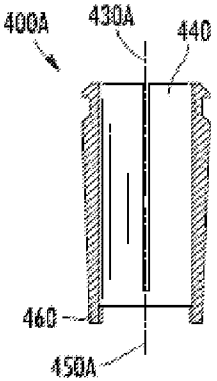
Figure 4A:
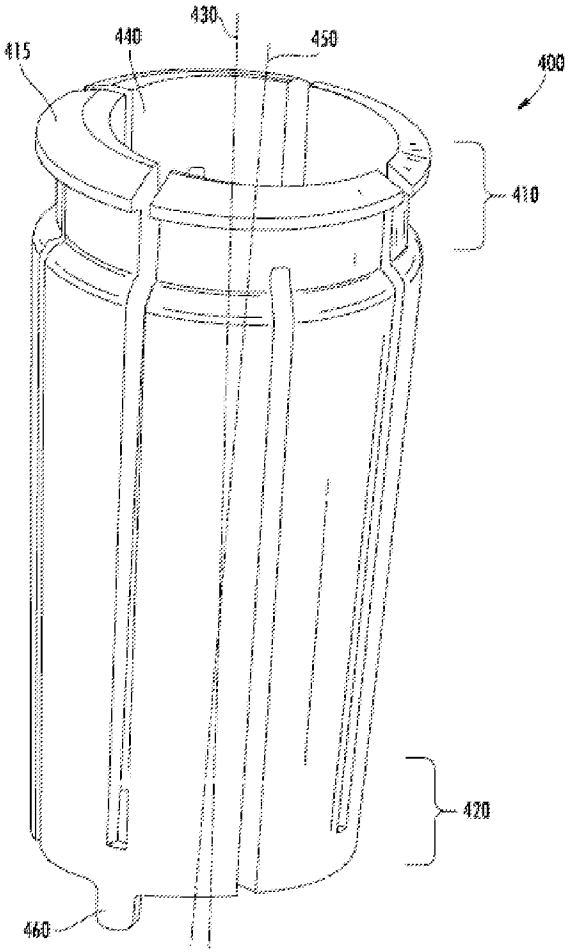

FIG. 4A shows a perspective view of collet 400. Collet 400 may be inserted into interior chamber 215 of golf club head 200. In some embodiments, collet 400 may be squeezed to contract the diameter of collet 400 while placing collet 400 into interior chamber 215. When pressure is released from collet 400, interior chamber 215 may be of an appropriate shape and size to retain collet 400 through a press fit with an exterior surface of collet 400. Collet 400 may be removed from golf club head 200 by squeezing the portion of collet 400 that is exposed above the hosel of golf club head 200 and pulling collet 400 out of interior chamber 215. Alternatively, in other embodiments, interior chamber 215 may releasably engage the exterior surface of collet 400 via any suitable methods or mechanisms. When collet 400 is inserted into and engaged with interior chamber 215, collet 400 may receive a golf club shaft or shaft adapter 300. In an aspect of the invention, the golf club shaft or shaft adapter 300 may fit tightly within collet 400 such that when the diameter of collet 400 is constricted slightly, the golf club shaft or shaft adapter 300 may prevent rotational movement of the shaft or shaft adapter 300 with respect to collet 400, and thus with respect to golf club head 200. In other embodiments of the invention, at least a portion of the exterior surface of collet 400 may be threaded or otherwise configured to mate with threaded structures of interior chamber 215 of golf club head 200.

As shown in FIG. 4A, collet 400 has a first end 410 and a second end 420, wherein the first end 410 is along the same axis 430 as the second end 420. The collet 400 may further include a bore 440 along a second axis 450 configured to receive a shaft member 106 or shaft adapter 300. Thus, the exterior of collet 400 extends in one axial direction (along axis 430) from the first end 410 to the second end 420, while the bore 440 that receives shaft member 106 or shaft adapter 300 extends in a second axial direction (axis 450). Those skilled in the art will readily appreciate upon review of this disclosure that there are various combinations of structural elements and/or processes that may be used to implement the two axes 430 and 450 of collet 400. The angular difference between the first axis 430 and the second axis 450, may be any angle, including 0 degrees (so that the axes are the same), without departing from this invention. In another preferred embodiment of the invention, the angle between first axis 430 and second axis 450 may be between 1 and 3 degrees. In one preferred embodiment of the invention, the angle between first axis 430 and second axis 450 may be between 0.5 and 7 degrees. Constant diameter of bore, but thickness of wall of collet varies.

In some embodiments, collet 400 may have a lip 415 proximate to the first end 410. Lip 415 may act as at least part of an engagement portion of collet 400. Lip 415 may be tapered away from axis 450 as shown in FIG. 4A. In some embodiments, ferrule (500, discussed below) may have an engagement mechanism that can slide over lip 415 and releasably engage collet 400. Collet 400 may have a rotation inhibiting structure to prevent rotation of collet 400 about the first axis 430 with respect to golf club head 200. One illustrative embodiment of such a rotation inhibiting structure is depicted in FIG. 4A as a protrusion 460 that extends longitudinally from the second end 420 of collet 400 and may be configured to engage rotation inhibiting structure 225 of interior chamber 215 of golf club head 200. One skilled in the art would readily appreciate that the protrusion 460 of collet 400 may also extend latitudinally or that the rotation inhibiting structure may be a mechanism other than protrusions, depending upon the mechanism and orientation of the rotation inhibiting structure 225 of interior chamber 215 without departing from the scope of this invention.

FIGS. 4B and 4C provide top views of two illustrative collets 400A and 400B, respectively. FIG. 4D provides a corresponding cross-sectional view of illustrative collet 400A taken along line 4D in FIG. 4B and FIG. 4E provides a corresponding cross-sectional view of illustrative collet 400B taken along line 4E in FIG. 4C. Collet 400A has a first axis 430A that is aligned with the second axis 450A. Collet 400B has a first axis 430B that is offset from the second axis 450B. As previously discussed, providing a first axis 430 that varies from a second axis 450 may allow the club shaft 106 to attach to the golf club head 200 at different angles depending upon the collet used. In embodiments where the first axis 430 is offset from second axis 450, a first end of collet 400 may have a first portion 403 that is thinner than a second portion 407 across from the first portion. Similarly, at a second end of collet 400, a third portion 413 (below the first portion 403) may be thicker than a fourth portion 417 (below the second portion 407). This variation in thickness may allow for aligning the shaft at different angles relative to the club head. Different angles with respect to the club head (e.g., face angle, lie angle, pitch angle, etc.) may be adjusted depending upon the orientation of collet 400. Moreover, collet 400 may be engaged with interior surface 215 of golf club head 200 at various orientations around the first axis 430 such that different characteristics of the golf club 100 can be altered depending upon the orientation of collet 400.

5. Ferrule

Figure 5:
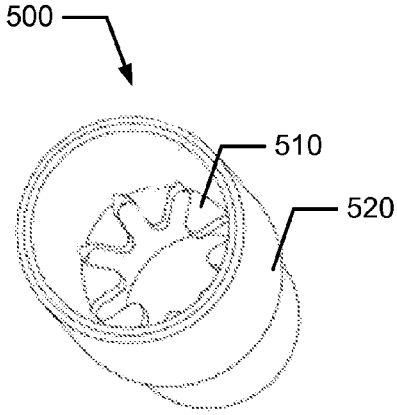
FIG. 5 generally illustrates a perspective view of a ferrule according to one embodiment of the invention.

Ferrule 500, depicted in FIG. 5, may be coaxially, slidably engaged with the golf club shaft such that ferrule 500 may move up and down the shaft. In one aspect of the invention, ferrule 500 may have an interior surface including an engagement portion 510 configured to releasably engage collet 400 and constrict the diameter of collet 400 which, in turn, may secure shaft member 106 and/or shaft adapter 300 to prevent rotational movement with respect to golf club head 200. In such an embodiment, ferrule 500 may have a sleeve 520 that may force engagement portion 510 towards the axis of ferrule 500 and when sleeve 520 is moved, engagement portion 510 may be concentrically withdrawn—i.e. engagement portion 510 may be configured to move away from the center of ferrule 500, providing clearance for engagement portion 510 to slide over lip 415 of collet 400. In another embodiment, once shaft member 106 or shaft adapter 300 is engaged with collet 400 and ferrule 500 is slid over and engaged with collet 400, a snap ring or similar device may be used to compress collet 400 and ferrule 500 such that shaft member 106 or shaft adapter 300 will not move relative to collet 400. In certain embodiments, a portion of ferrule 500 may be threaded to engage a threaded portion of receiving mechanism 220. In some embodiments, turning the ferrule counterclockwise may provide a mechanical advantage to release collet 400 from interior chamber 215 of golf club head 200. Other embodiments may provide other well known devices to provide a mechanical advantage to release collet 400 from interior chamber 215 in order to disengage connection assembly 104.

6. Boot

Figure 6:
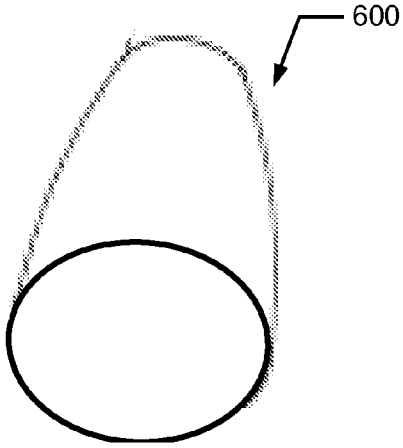
FIG. 6 generally illustrates a perspective view of a boot according to one embodiment of the invention.

Golf club 100 may also optionally include boot 600 as shown in FIG. 6. Boot 600 may cover the portions of releasable club head/shaft connection assembly 104. Boot 600 may be constructed of rubber or some similarly flexible material to conceal any gaps that may occur due to any differences between the first axis 430 of collet 400 and the second axis 450 of collet 400.

B. Discussion of Specific Embodiments of Connection Assembly

Figure 7A:
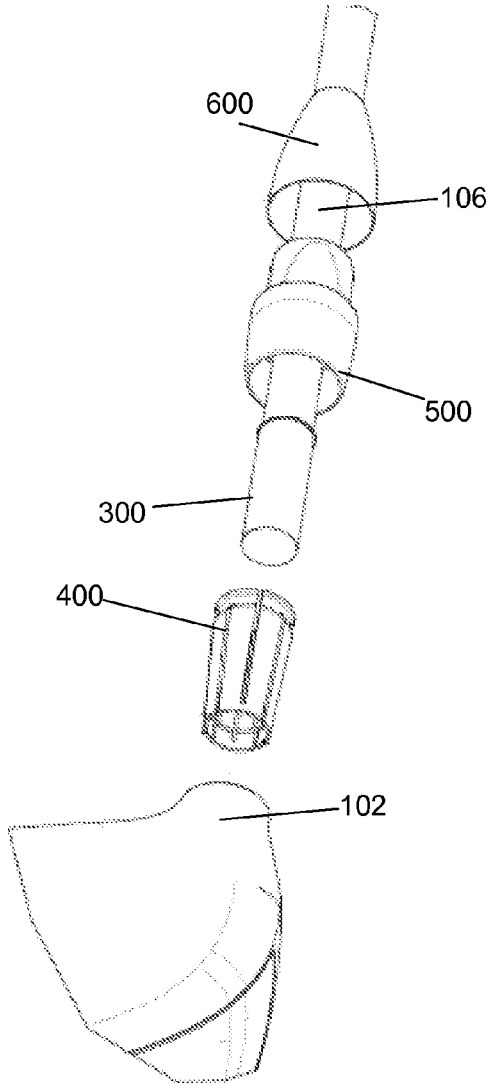
FIGS. 7A and 7B provide an illustrative embodiment of a golf club having certain elements as previously discussed in relation to FIGS. 1-6.
Figure 7B:
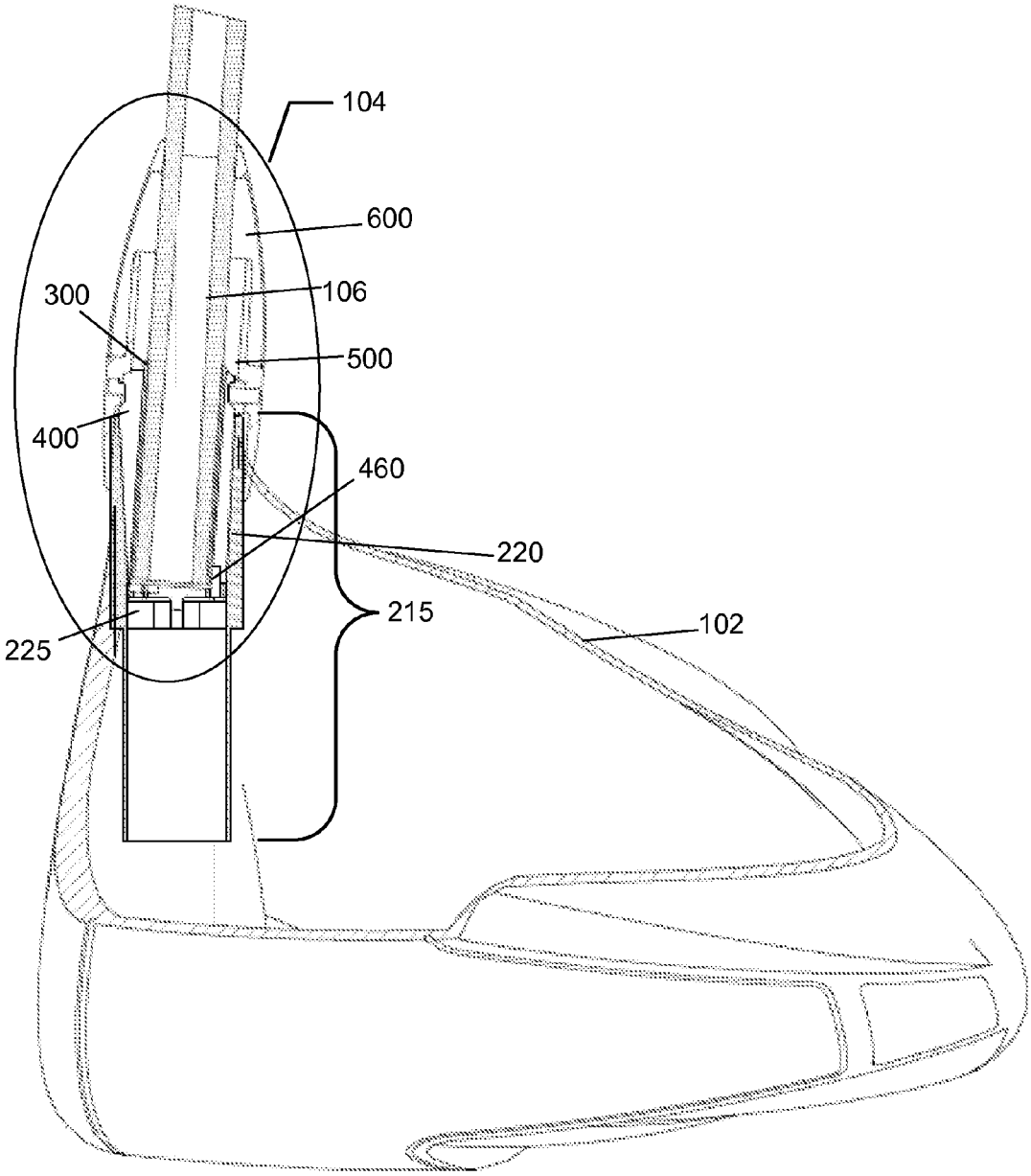

To more readily show certain novel aspects of the invention, FIGS. 7A and 7B provide an illustrative embodiment of a golf club having selected elements as previously discussed in relation to FIGS. 1-6. To more clearly demonstrate the selected aspects, the various elements of FIGS. 7A and 7B have been consistently labeled with the reference numerals as provided in the previous figures to allow the reader to quickly refer back to the respective FIG. 1*f* required. As evident from viewing the exploded perspective view of FIG. 7A and the assembled cross-sectional view of FIG. 7B, the angle and/or position of the free end of the shaft 106 (at the location of the grip, remote from the connection assembly 104) may be altered with respect to the club head 102 (and with respect to the ball striking face) by differing the rotational placement of collet 400 within the club head 102. Additionally, the angle and/or position of the free end of the shaft 106 (at the location of the grip, remote from the connection assembly 104) may be altered with respect to the club head 102 (and with respect to the ball striking face) by using collets with first axes that differ from second axes by various angles.

Specifically, FIG. 7B shows an enlarged cross-sectional view of connection assembly 104 according to one embodiment. As shown, the rotation inhibiting structure (protrusions 460) of collet 400 is selectively received within rotation inhibiting structure 225 of interior chamber 215 of club head 102. Depending on how collet 400 is placed within club head 200, and thus how the club shaft 106 is oriented in relation to the "face" of the club head 102, the playing characteristics of the club (e.g., its face angle, its loft angle, its lie angle, etc.) may be adjusted. This feature, along with the releasable connection assembly 104, allows club fitters (or others) to freely and easily adjust various angles and/or positions of the shaft 106 with respect to the club head 102 (e.g., variable lie, loft, and face angle combinations) while still using the same shaft 108 and head 102, which can help users more easily determine the optimum club head/shaft combination and arrangement to suit their needs.

Receiving mechanism 220 proximate to the exterior portion of the golf club head 200 is configured to releasably receive and secure a collet 400 and/or ferrule 500. As shown in the example of FIG. 7B, receiving mechanism 220 includes a bore in interior chamber 215 of the golf club head 200 that is sized to receive collet 400. As collet 400 slides into club head 102, the rotation-inhibiting structures 225 of club head 102 will engage corresponding rotation-inhibiting structures (protrusions 460) of collet 400 to thereby prevent collet 400 from rotating with respect to the club head 102. Once collet 400 is rotatably and slidably engaged with receiving mechanism 220, the overall connection assembly 104 then may be assembled. This is accomplished in this example connection assembly 104 by sliding the shaft 106 into the upper end 305 of shaft adapter 300 with ferrule 500 located on shaft 106 above shaft adapter 300. If desired, shaft 106 may be fixed to shaft adapter 300, e.g., by cements or adhesives, by mechanical connectors, etc. Shaft adapter 300 may then slide into collet 400, which may be engaged with club head 102.

Shaft adapter 300 in this example assembly 104 helps prevent any substantial "play" or movement of the shaft 106 with respect to club head 102, e.g., due to tolerances in the rotation-inhibiting structures 225 and 460. Specifically, shaft adapter 300 may slide into and fit within collet 400, which may be engaged with interior chamber 215 of club head 102. Shaft adapter 300 may be made from a more compressible material, such as rubber that increases the surface tension between shaft adapter 300 and club head 102.

In addition to helping hold shaft 106, the material of shaft adapter 300 can help attenuate or eliminate noises, e.g., by preventing the metallic parts of the connection assembly 104 from slightly moving with respect to one another or rattling when the club head 102 is moved and/or when a ball is struck. If desired, shaft adapter 300 may be omitted, relocated, and/or integrally formed as part of the shaft, the club head, etc. As discussed above, those skilled in the art will readily appreciate the vast quantity of additional materials that may be utilized to construct shaft adapter 300 for use in various embodiments.

Next in the assembly process, ferrule 500 may engage collet 400 and constrict the interior diameter of collet 400, thereby restricting movement of shaft 106 and shaft adapter 300 with respect to club head 102. Ferrule 500 slides down shaft 106 and/or shaft adapter 300, covering the upper end of shaft adapter 300. In some embodiments, ferrule 500 may threadingly engage threaded securing structures of receiving mechanism 220 provided on club head 102. As discussed above, other releasable mechanical connection systems are possible without departing from this invention. Also, the various steps in this example assembly procedure may be changed, combined, changed in order, etc., without departing from this invention.

To release the connection of the assembly 104, ferrule 500 is released from the club head receiving mechanism 220 or from collet 400, which allows ferrule 500 to be disengaged from collet 400, allowing collet 400 to expand slightly. Shaft 106 and/or shaft adapter 300 then may be easily slid out of collet 400. In this manner, a different shaft can be quickly and easily engaged with the same club head 102 and/or a different club head can be quickly and easily engaged with the same shaft 106. Moreover, in some instances, collet 400 may also be removed from club head 102 in order to use a different collet with club head 102. The new collet may have a different offset angle of the first axis from the second axis as discussed above. Alternatively, if desired, shaft 106 or collet 400 may be rotated with respect to the club head 102 to vary the angles noted above, and these same parts then may be re-engaged with one another at the different rotational orientation. Those skilled in the art will readily appreciate that methods relating to disassembling the assembly 104 is within the scope of the invention.

If desired, as illustrated in FIGS. 7A and 7B, and as illustrated in FIG. 6, boot 600 may be provided above ferrule 500, to cover some or all of the shaft adapter 300 and/or ferrule 500, and, if desired, to make the hosel junction appear more like a conventional hosel junction.

C. Additional Embodiments

1. Generally

The releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using suitable (and permanent) mounting techniques (e.g., cements or adhesives). Other variations in the club/shaft connection assembly parts and processes are possible without departing from this invention.

2. Kits

Indeed, as one example, one or more elements or components of a golf club may be marketed, sold, or utilized as a kit. One such embodiment may include a kit including a golf club head having an interior chamber configured to releasably secure a collet, which in turn is configured to receive an insertable shaft adapter. The same kit may be associated with instructions for constructing a golf club with the head and choosing between one or more shafts and/or other elements to construct a golf club. In certain embodiments, the instructions will describe a method for: releasably inserting a collet into an interior chamber of a golf club head, wherein the interior chamber includes a rotation inhibiting structure that engages a rotation inhibiting structure of the collet, preventing rotation of the collet within the golf club head, wherein the collet is configured to be releasably received within the interior chamber of the golf club head at a plurality of different locations. The instructions may further describe a method of releasably inserting a shaft adapter into the collet; and releasably securing a ferrule to the collet, constricting the diameter of the collet.

One skilled in the art will readily appreciate that other components besides or as a replacement to the club head may be included in the kit. For example, the kit may contain one or more shafts, shaft adapters, collets, ferrules, grips, heads, and/or instructions depending on the various embodiments. The kit may further include information relating to the face angle, lie angle, and loft angle of the club head in relation to an orientation of a specific collet in the interior chamber of a specific club head. One skilled in the art will readily appreciate that the instructions are not required to be printed and remain physically present with the other components of the kit, but rather the instructions may be provided on a computer-readable medium. Such instructions may reside on a server that the user may access. In accordance with certain embodiments, the user may be provided information, such as a link to an address on the Internet, which includes the instructions, which would fall within the scope of providing instructions. Thus, as used herein, providing instructions is not limited to printed copies that are deliverable with a physical element of the golf club.

3. Axial Direction Change Regions

Other structures of the golf club 100 may be used in conjunction with the connection assembly 104 described above in connection with FIGS. 2A through 7B to further increase the benefits of the disclosed golf club. For example, additional structures may further include an axial direction change region. Illustrative shafts having one or more direction change regions are fully disclosed and described in U.S. application Ser. No. 11/774,522, which is entirely incorporated herein by reference now U.S. Pat. No. 7,704,156 B2. Further, such shafts may be used with other releasable golf club head/shaft connection arrangements, such as those described in U.S. Pat. No. 6,890,269 (Bruce D. Burrows) and U.S. Published Patent Appln. No. 2004/0018886 (Bruce D. Burrows), each of which is entirely incorporated herein by reference. Moreover, various aspects of the invention described above may be used in connection with other patented, pending, and/or commercially available releasable golf club shaft assemblies.

Any desired axial direction change (or bend) angles may be used for one or more direction changes without departing from this invention, e.g., at least 0.25 degrees, at least 0.5 degrees, at least 1 degree, at least 2 degrees, at least 4 degrees, or even at least 8 degrees. In some example structures, particularly when the shaft itself includes one or more bends, the bends or other axial direction changes will be between 0.25 and 25 degrees, between 0.5 and 15 degrees, between 1 and 10 degrees, or even between 1 and 5 degrees. In other example structures, these bends or other axial direction changes will be between 25 and 145 degrees, between 30 and 120 degrees, between 45 and 100 degrees, or even between 60 and 90 degrees. If desired, one bend may be relatively slight while another is more abrupt. The bends or axial direction changes may be arranged so that the free ends of the shaft lie on the same plane or on different planes. Also, if desired, more than two bends or axial direction change regions may be provided in a club head shaft structure without departing from this invention.

The methods and devices described herein may also apply to other areas requiring the releasable, interchangeable attachment of two components for altering characteristics (including angles of attachment or size of components such as handles or grips) of the assembled components. Examples may include other sporting goods equipment such as a tennis racket (grip and head) or a fencing sword (grip and blade), gardening equipment such as weed eaters (handle and head) or rakes (grips and blades). Many variations in the overall structure of the shaft, club head, and club head/shaft connection assembly are possible without departing from this invention. Furthermore, the various steps of the described assembly processes may be altered, changed in order, combined, and/or omitted without departing from the invention. Additionally or alternatively, if desired, in such structures, the club head can be quickly and easily exchanged for a different one on the shaft (e.g., a club head of different loft, lie angle, size, brand, etc.).

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A method for assembling a golf club comprising:

releasably inserting a collet into an interior chamber of a golf club head, wherein the golf club comprises a rotation inhibiting structure in the interior chamber that engages a rotation inhibiting structure of the collet, preventing rotation of the collet within the golf club head, wherein the collet is configured to be releasably received within the interior chamber of the golf club head at a plurality of different configurations, wherein at least one configuration provides different club characteristics than another configuration;

releasably inserting a shaft adapter into the collet; and releasably securing a ferrule to the collet, constricting the diameter of the collet.

2. The method of claim 1, wherein the shaft adapter comprises a hollow upper end and the method further comprises inserting a shaft into the upper end of the shaft adapter.

3. The method of claim 1, wherein the shaft adapter comprises a free end of a shaft.

4. The method of claim 1, wherein the shaft adapter comprises an axial direction change region.

5. The method of claim 4, wherein the axial direction change region of the shaft adapter is configured to offset an axis of the shaft with respect to a hosel axis of the golf club head about 2.5 degrees.

6. The method of claim 1, wherein the collet comprises an axial direction change region.

7. The method of claim 6, wherein the axial direction change region of the collet is configured to offset an axis of the shaft with respect to a hosel axis of the golf club head about 2.5 degrees.

8. The method of claim 1, wherein the rotation inhibiting structure of the club head includes at least two recesses.

9. The method of claim 1, wherein there are at least six different configurations at which the collet is configured to be releasably secured within the interior chamber of the golf club head.

10. The method of claim 1, wherein the rotation inhibiting structure of the collet includes at least one protrusion longitudinally extending from an end of the collet and wherein the rotational inhibiting structure of the interior chamber has at least one recess to receive the at least one protrusion.

11. A method for connecting components of a golf club comprising:

releasably inserting a collet into an interior chamber of a golf club head, wherein the golf club head comprises a rotation inhibiting structure in the interior chamber that engages a rotation inhibiting structure of the collet, preventing rotation of the collet within the golf club head, wherein the collet is configured to be releasably received within the interior chamber of the golf club head at a plurality of different configurations, and wherein at least one configuration provides different characteristics than another configuration;

releasably inserting an adapter into the collet; and releasably securing a ferrule to the collet, constricting the diameter of the collet.

12. The method of claim 11, wherein the adapter comprises a hollow upper end and the method further comprises inserting a shaft into the upper end of the adapter.

13. The method of claim 11, wherein the adapter comprises an axial direction change region.

14. The method of claim 13, wherein the axial direction change region is configured to offset an axis of the shaft with respect to a hosel axis of the golf club head about 2.5 degrees.

15. The method of claim 11, wherein the collet comprises an axial direction change region.

16. The method of claim 15, wherein the axial direction change region of the collet is configured to offset an axis of the shaft with respect to a hosel axis of the golf club head about 2.5 degrees.

17. The method of claim 11, wherein there are at least six different configurations at which the collet is configured to be releasably secured within the interior chamber of the first component.

18. The method of claim 11, wherein the rotation inhibiting structure of the collet includes at least one protrusion longitudinally extending from an end of the collet and wherein the rotational inhibiting structure of the interior chamber has at least one recess to receive the at least one protrusion.

* * * * *